US009824830B2

(12) United States Patent
Ness

(10) Patent No.: US 9,824,830 B2
(45) Date of Patent: Nov. 21, 2017

(54) SWITCH, IN PARTICULAR LOAD INTERRUPTER SWITCH

(71) Applicant: Siemens Aktiengesellschaft, Munich (DE)

(72) Inventor: Franz Ness, Bayerbach (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 211 days.

(21) Appl. No.: 14/691,619

(22) Filed: Apr. 21, 2015

(65) Prior Publication Data

US 2015/0311004 A1 Oct. 29, 2015

(30) Foreign Application Priority Data

Apr. 24, 2014 (EP) ..... 14165718

(51) Int. Cl.
*H01H 1/36* (2006.01)
*H01H 1/42* (2006.01)
(Continued)

(52) U.S. Cl.
CPC ..... *H01H 1/36* (2013.01); *H01H 1/42* (2013.01); *H01H 1/2041* (2013.01); *H01H 9/106* (2013.01)

(58) Field of Classification Search
CPC ..... H01H 1/36; H01H 1/42; H01H 1/2041; H01H 31/00; H01H 33/00; H01H 3/32
See application file for complete search history.

(56) References Cited

U.S. PATENT DOCUMENTS 6,222,139 B1 * 4/2001 Pandit ..... H01H 1/2041 200/11 A
7,223,928 B2 * 5/2007 Riopka ..... H01H 31/00 200/48 P
(Continued)

FOREIGN PATENT DOCUMENTS

CH 644224 A5 7/1984
DE 3223654 A1 1/1984
(Continued)

OTHER PUBLICATIONS

International Search Report dated Sep. 29, 2014.
Extended European Search Report dated Dec. 12, 2016.

*Primary Examiner* — Kyung Lee
(74) *Attorney, Agent, or Firm* — Harness, Dickey & Pierce, P.L.C.

(57) ABSTRACT

A switch includes connection elements, connectable via a switching contact whose movable contact area is formed on a movable contact element which bears against the stationary contact area in the closed position. In order to achieve a design with improved positional accuracy, an embodiment of the invention proposes that the two connection elements and the movable contact element each have a planar flat side and all flat sides lie in a common plane. In an embodiment, the connection elements are arranged on one side of the common plane and the movable contact element is arranged on the other side; a subarea of the flat side of one connection element forms the stationary contact area; a subarea of the flat side of the other connection element forms a planar bearing area; and the movable contact element with its flat side bears movably against the bearing area.

17 Claims, 5 Drawing Sheets

(51) Int. Cl.
*H01H 1/20* (2006.01)
*H01H 9/10* (2006.01)

(56) References Cited

U.S. PATENT DOCUMENTS

| | | | | |
|---|---|---|---|---|
| 8,013,263 | B2 * | 9/2011 | Lindsey | H01H 9/0044 200/11 TC |
| 8,658,923 | B2 * | 2/2014 | Weber | H01H 19/02 200/11 TC |
| 9,070,519 | B2 * | 6/2015 | Marushima | H01H 3/32 |
| 2014/0090969 | A1 * | 4/2014 | Uitto | H01H 1/2041 200/571 |
| 2014/0091062 | A1 | 4/2014 | Uitto et al. | |
| 2014/0097154 | A1 | 4/2014 | Uitto et al. | |
| 2014/0097155 | A1 | 4/2014 | Uitto et al. | |

FOREIGN PATENT DOCUMENTS

| | | | |
|---|---|---|---|
| DE | 10 2011 0788 46 | A1 | 3/2012 |
| EP | 1085542 | A2 | 3/2001 |
| FR | 2891395 | A1 | 3/2007 |
| WO | WO-2012168553 | A1 | 12/2012 |

* cited by examiner

SWITCH, IN PARTICULAR LOAD INTERRUPTER SWITCH

PRIORITY STATEMENT

The present application hereby claims priority under 35 U.S.C. §119 to European patent application number EP14165718.9 filed Apr. 24, 2014, the entire contents of which are hereby incorporated herein by reference.

FIELD

At least one embodiment of the invention generally relates to a switch, in particular a load interrupter switch.

BACKGROUND

Switches in the form of load interrupter switches nowadays have a modular design and consist of pole cassettes, which are usually assembled from two plastic shells. Connection elements are connected to one another via a switching contact during closing of the switch, the switching contact having a stationary and a movable contact element formed from current-conducting copper parts and having a planar contact area, wherein the movable contact element, over the course of the closing process, pivots out of an open position into a closed position.

The mutually facing contact areas which are aligned parallel to one another in the process slide bearing against one another, for example, into the closed position. The copper parts of the connection elements are fixedly clamped in grooves provided between the plastic shells.

This design, owing to the component part tolerances, results in a system with multiple overdeterminacies, which firstly result in positional inaccuracies of the component parts with respect to one another and secondly mean that fitting requires considerable force. This has a negative influence on the opening and closing behavior of the switch, for example asymmetrical striking of the arc, which then can result in severe fusing of the contact elements in the event of a short circuit. In addition, the grooves in the plastic shells, which grooves are fixed in terms of their dimensions given a switch size, each require an identical thickness of the copper parts and therefore always the same amount of copper, even if the switch is rated for different rated current intensities, which has a direct effect on the production costs since the costs of the copper make up a large proportion of the component costs.

The problem of the positional inaccuracies can be solved by highly precise geometries and dimensions of the component parts including housing parts, with the disadvantage that increased production costs need to be accepted, in particular in the case of switches designed for low currents.

SUMMARY

At least one embodiment of the invention reduces positional inaccuracies of the components parts with respect to one another without using component parts with smaller tolerances.

The dependent claims set forth advantageous configurations.

At least one embodiment envisages that the two connection elements and the movable contact element each have a planar flat side and all of the flat sides lie in a common plane, wherein the connection elements are arranged on one side of the common plane and the movably mounted contact element is arranged on the other side, that a subarea of the flat side of one connection element forms the stationary contact area, that a subarea of the flat side of the other connection element forms a planar bearing area, and that the movable contact element bears with its flat side movably against the bearing area, and that a subarea of its flat side forms the movable contact area. All of the important areas of the component parts (connection elements, contact elements, supporting elements) are therefore in one common plane. This results in increased positional accuracy of the connection and contact elements and therefore of the current-conducting copper parts with respect to one another.

BRIEF DESCRIPTION OF THE DRAWINGS

Embodiments of the invention will be described in more detail below with reference to the drawing figures, in which.

DETAILED DESCRIPTION OF THE EXAMPLE EMBODIMENTS

Figure 1:
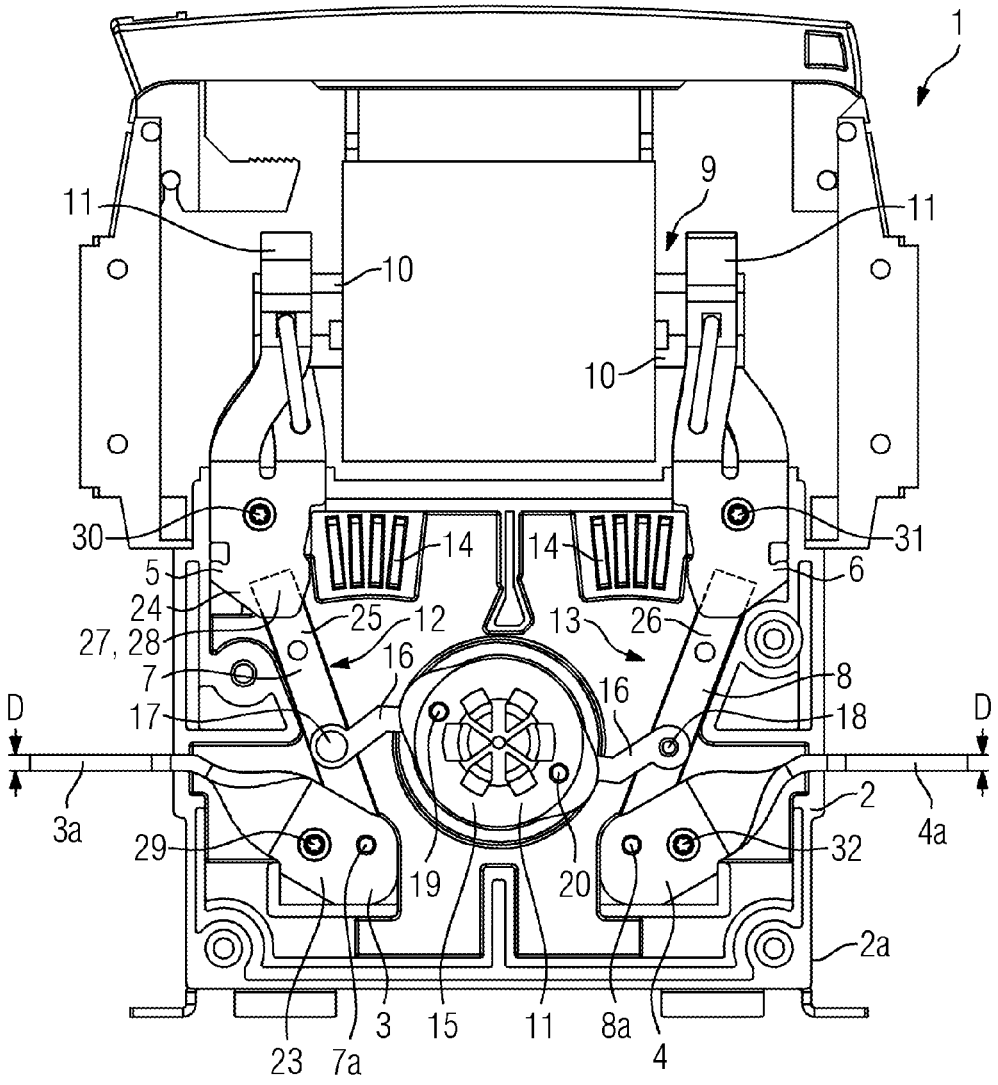
FIG. 1 shows a switch with a front housing shell removed and the switching contacts closed.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Before discussing example embodiments in more detail, it is noted that some example embodiments are described as processes or methods depicted as flowcharts. Although the flowcharts describe the operations as sequential processes, many of the operations may be performed in parallel, concurrently or simultaneously. In addition, the order of operations may be re-arranged. The processes may be terminated when their operations are completed, but may also have additional steps not included in the figure. The processes may correspond to methods, functions, procedures, subroutines, subprograms, etc.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Portions of the example embodiments and corresponding detailed description may be presented in terms of software, or algorithms and symbolic representations of operation on data bits within a computer memory. These descriptions and representations are the ones by which those of ordinary skill in the art effectively convey the substance of their work to others of ordinary skill in the art. An algorithm, as the term is used here, and as it is used generally, is conceived to be a self-consistent sequence of steps leading to a desired result. The steps are those requiring physical manipulations of physical quantities. Usually, though not necessarily, these quantities take the form of optical, electrical, or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise, or as is apparent from the discussion, terms such as "processing" or "computing" or "calculating" or "determining" of "displaying" or the like, refer to the action and processes of a computer system, or similar electronic computing device/hardware, that manipulates and transforms data represented as physical, electronic quantities within the computer system's registers and memories into other data similarly represented as physical quantities within the computer system memories or registers or other such information storage, transmission or display devices.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

At least one embodiment envisages that the two connection elements and the movable contact element each have a planar flat side and all of the flat sides lie in a common plane, wherein the connection elements are arranged on one side of the common plane and the movably mounted contact element is arranged on the other side, that a subarea of the flat side of one connection element forms the stationary contact area, that a subarea of the flat side of the other connection element forms a planar bearing area, and that the movable contact element bears with its flat side movably against the bearing area, and that a subarea of its flat side forms the movable contact area. All of the important areas of the component parts (connection elements, contact elements, supporting elements) are therefore in one common plane. This results in increased positional accuracy of the connection and contact elements and therefore of the current-conducting copper parts with respect to one another.

It is technically simple if supporting elements having supporting areas are arranged on the side of the first contact element and the flat sides of the connection elements bear against the supporting areas.

In a simple embodiment, the movable contact element is formed from a flat body, with the movable contact area being arranged on one end thereof and the bearing area bearing against the other end thereof.

It is technically simple if the movable contact element is in the form of a pivoting lever and is mounted pivotably.

A technically simple embodiment results if the switch has a housing shell and the supporting elements are integrally formed internally on the housing wall and the connection elements and the movable contact element are arranged in the housing shell.

The production is simplified further if the two connection elements are plate-shaped and have the same thickness.

The current loading can be increased if the two connection elements have flat sides which are remote from one another on both sides and which run parallel to one another, and if a further movable contact element with a flat side is opposite the movable contact element, wherein the two movable contact elements pivot in synchronism and the flat sides thereof face one another and are spaced apart from one another corresponding to the thickness of the connection elements so that they form a slot, which receives the connection element when the switching contact closes, wherein the movable contact areas of the two contact elements make contact on both sides with stationary contact areas of the connection element.

Advantageously, the two flat sides of the two movable contact elements then each lie in a common plane with the corresponding flat sides of the two connection elements, wherein the two common planes are spaced apart from one another corresponding to the thickness of the connection elements.

Low transfer resistances are achieved if the two connection elements are each formed integrally from a flat material with the corresponding thickness by bending.

All of the current-conducting parts including the contact and connection elements are therefore fastened in a single shell, for example via screwing, not by plugging-in and clamping in grooves which pass through the two shell walls. In this case, the fastening of the flat sides of the contact and connection elements is performed in a common plane, as a result of which minimum positional inaccuracies of the current-conducting parts with respect to one another result. The parts can thus be matched to the rated current intensity more flexibly, i.e. the rated current determines the thickness of the contact and connection elements and the thickness thereof in each case only needs to be as large as is actually required. The current-conducting parts are therefore also easily matchable to the rated currents within a physical size (housing size). A switch of a physical size can therefore be provided for 32 A simply with a 1.5 mm thickness of the contact and connection elements as current-conducting parts, with a thickness of 2 mm for 80 A, and so on. And this is without changing and therefore impairing the positional accuracies and without all other component parts of the switch needing to be changed, in particular as regards tolerances, which enables a very flexible switch construction kit.

Increased positional accuracies also improve the switching behavior, in particular in the case of short circuits (arc no longer strikes asymmetrically). At the same time, the requirements for the component part tolerances are reduced. Thus, the housing shell can have less precise tolerances since it is no longer overdetermined by the connection of the copper parts. Furthermore, the fitting is simplified since overdeterminacies are no longer provided.

FIG. 1 shows a switch 1 in the form of a load interrupter switch, which has a pole cassette produced in an injection-molding process, for example, as housing 2. Of the open housing 2, only the rear shell 2*a* (housing shell) can be seen in FIG. 1; the removed front shell is not shown.

Two connection elements 3, 4 having connection lugs 3*a*, 4*a* which are passed to the outside through the housing 2 are produced integrally from plate-shaped copper flat material (copper plates) by bending and are used for connecting the switch 1 to corresponding power supply lines. Further connection elements 5, 6 which are likewise produced from plate-shaped copper flat material (copper plates) are located above the connection elements 3, 4 in FIG. 1. In this case, in each case two connection elements 3, 5 and 4, 6 are electrically connected to one another via an elongate contact element 7, 8, which is likewise produced from copper flat material and is pivotable in the manner of a pivoting lever in each case about an axis 7*a* and an axis 8*a*, respectively. Furthermore, a fuse 9 connects the connection elements 5, 6 at the top to one another (see FIGS. 5 and 7), which connection elements are bent at the two upper ends to form u-shaped fuse holders 11, wherein two contact blades 10 of the fuse 9 are plugged into and fixedly clamped in the fuse holders 11.

When the switch 1 is closed, the current flows from left to right, i.e. from the connection element 3 via the contact element 7 to the connection element 5 and from there via the fuse 9 to the connection element 6 and from there via the contact element 8 to the connection element 4, or else in the opposite direction from right to left.

The connection elements 3, 5 and the movable contact element 7 form a switching contact 12, and the connection elements 4, 6 and the movable contact element 8 form a switching contact 13, which are both closed in FIG. 1. Both switching contacts 12, 13 are arranged mirror-symmetrically with respect to one another and have an identical design.

The description below is therefore substantially on the basis of the switching contact 12 arranged on the left-hand side in FIG. 1; the statements also apply correspondingly to the switching contact 13. The mutually corresponding reference symbols are listed at the end of the description.

Arc splitter plates 14 are arranged in the region of the upper end of the contact element 7 in order to quench arcs occurring during opening or closing of the switching contact 12. A switching shaft 15 is located centrally approximately in the center of the shell 2*a* and is connected in articulated fashion to the movable contact element 7 via connecting rods 16 and spindles 17, 19.

The connection elements 3, 5 (including connection lug 3*a*) have the same thickness D, i.e. their two parallel planar flat sides 21, 22, 23, 24 (see FIGS. 4 and 5) are spaced apart from one another corresponding to the material thickness D.

The pivotably mounted contact element 7 likewise has in each case one planar flat side 25, which bears against the opposite planar flat sides 21, 22 (see FIGS. 4 and 5) of the connection elements 3, 5.

The flat sides 21, 22, 25 in this case lie in a common plane E (see FIGS. 6 and 9), wherein the connection elements 3, 5 lie on one side of the common plane E and the pivotably mounted contact element 7 lies on the other side.

A subarea of the flat side 21 of the connection element 3 forms a planar bearing area, on which the contact element 7 is mounted pivotably about the axis 7*a*, wherein the contact element bears with its flat side 25 against this bearing area.

Figure 4:
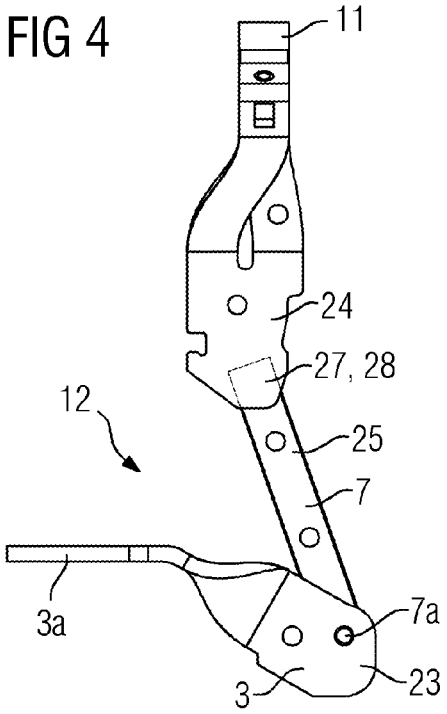
FIG. 4 shows a closed switching contact as shown in FIG. 1 having connection elements and a contact element.
Figure 6:
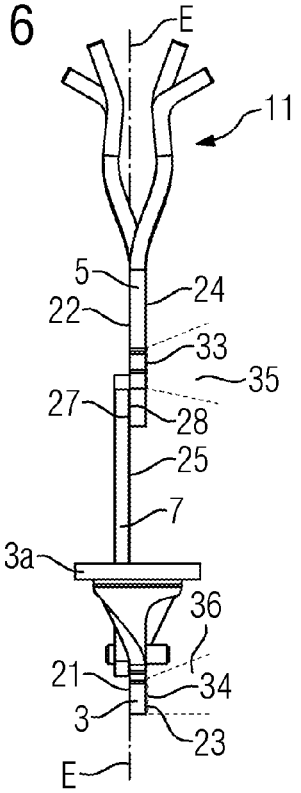
FIG. 6 shows the closed switching contact as shown in FIG. 4 with a view from the side.
Figure 8:
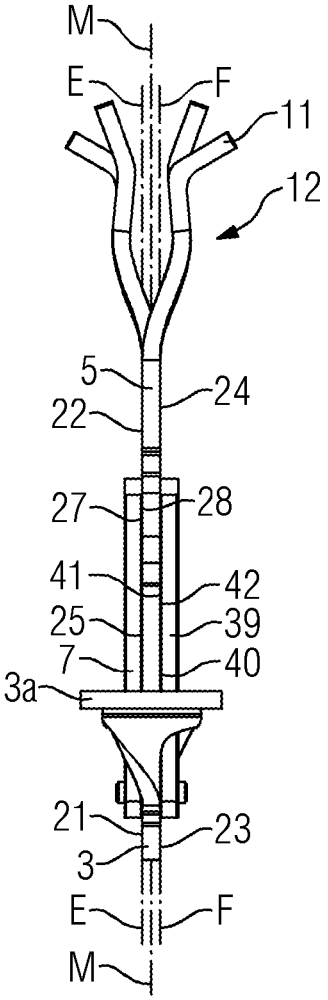
FIG. 8 shows the closed switching contact as shown in FIG. 7 with a view from the side.

A subarea of the flat side 25 forms a movable contact area 27 and a subarea of the flat side 22 of the connection element 5 forms a stationary contact area 28 (hidden in FIG. 1 and therefore illustrated by dashed lines; see also FIGS. 4, 6 and 8).

The two contact areas 27, 28, as well as the associated planar flat sides 22, 25, face one another and are oriented parallel to one another and bear against one another in FIG. 1, in which the closed position is shown.

The connection elements 3, 5 are fastened to the half-shell 2*a* via screws 29, 30 (single-shell screwing), wherein the flat sides 21, 22 bear against supporting areas 33, 34 (see FIG. 3), which in this case are planar and likewise lie in the common plane E. In principle, it is advantageous to design the supporting areas 33, 34 as planar areas in the shell 2*a*, but supporting points also lying in the common plane E (in the shell 2*a*) could also be used for supporting purposes instead of supporting areas 33, 34. The supporting areas 33, 34 are therefore to be understood by way of example in this case.

Figure 2:
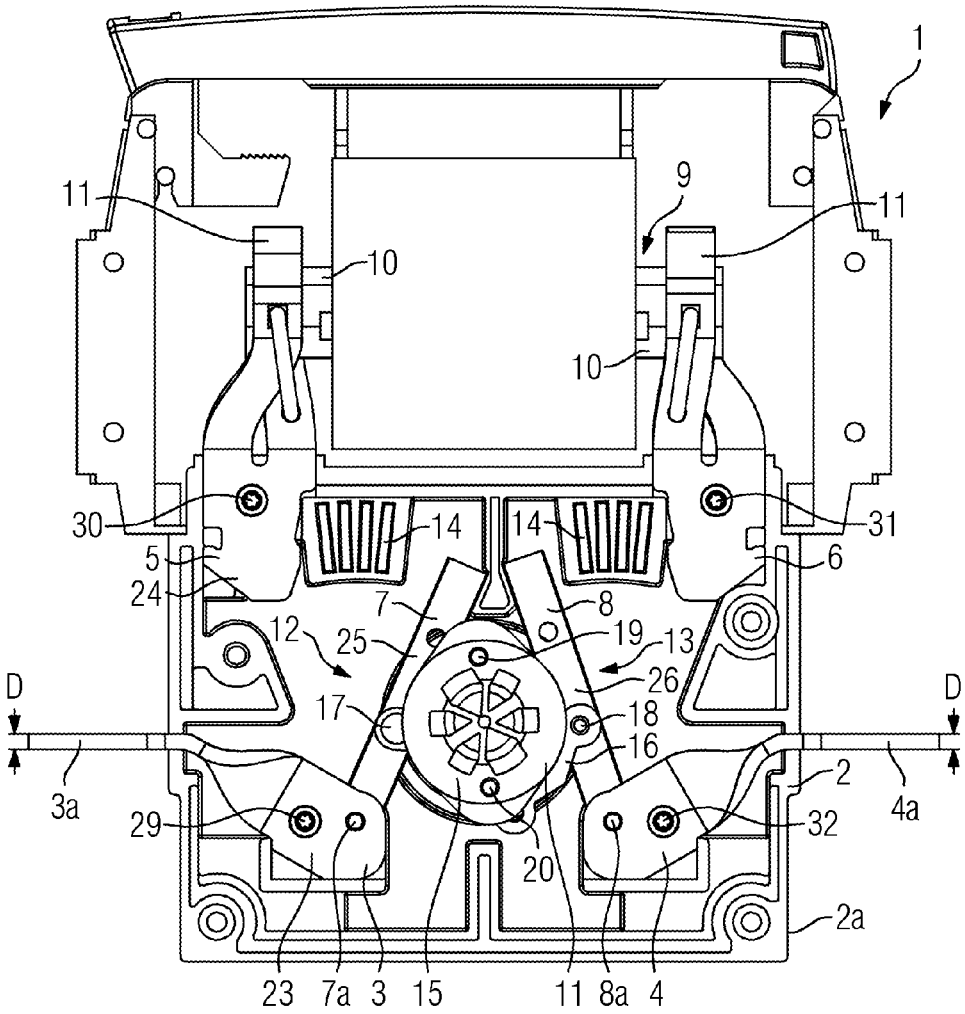
FIG. 2 shows the switch shown in FIG. 1 with the switching contacts open.

FIG. 2 shows the switch 1 after rotation of the switching shaft 15 in the clockwise direction with the contact element 7 pivoted inwards towards the switching shaft 15. In this switch position, the switching contact 12 and therefore the switch 1 is open. Over the course of the opening process, the contact areas 27, 28 intersect one another to a decreasing extent, when viewed transversely with respect to the contact areas 27, 28 (over the course of the closing process they intersect one another correspondingly to an increasing extent), i.e. the intersection of the contact areas 27, 28 decreases during the opening process.

Figure 3:
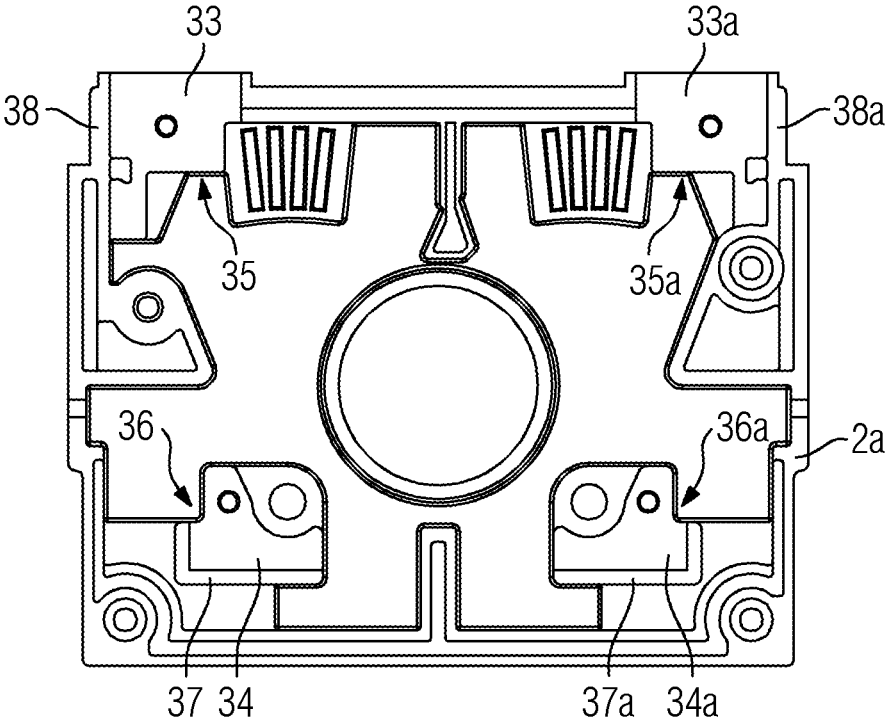
FIG. 3 shows the empty rear housing shell of the switch as shown in FIG. 1 and FIG. 2.

FIG. 3 only shows the shell 2*a* (the lower part of the housing 2) so that the supporting areas 33, 34 lying in the common plane E can clearly be seen, which supporting areas are formed on the supporting elements 35, 36 which are integrally formed internally on the housing wall. The tolerances are provided over the common plane E, which is also the reference plane for the dimensions of the shell 2*a*. The supporting elements 35, 36 are in this case shapes in the plastic shell 2*a*. In order to prevent twisting of the connection elements 3, 5, bearing projections 37, 38 are provided, against which the connection elements 3, 5 bear laterally.

FIG. 4 shows only the closed switching contact 12 shown in FIG. 1 with the connection elements 3, 5 and the contact element 7.

Figure 5:
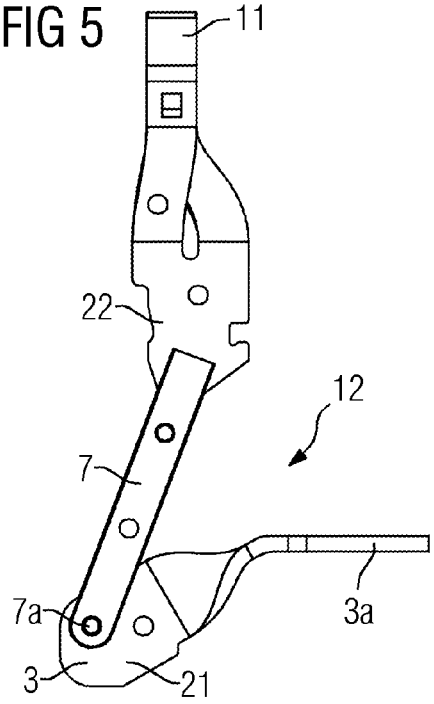
FIG. 5 shows the closed switching contact as shown in FIG. 4 with a view from the rear.

FIG. 5 shows the switching contact 12 shown in FIG. 4 from the rear.

FIG. 6 shows the switching contact 12 shown in FIG. 4 additionally also from the side. In this case, the supporting elements 35, 36 with the supporting areas 33, 34 are illustrated very schematically (and therefore by dashed lines) for better understanding in FIG. 6.

Figure 7:
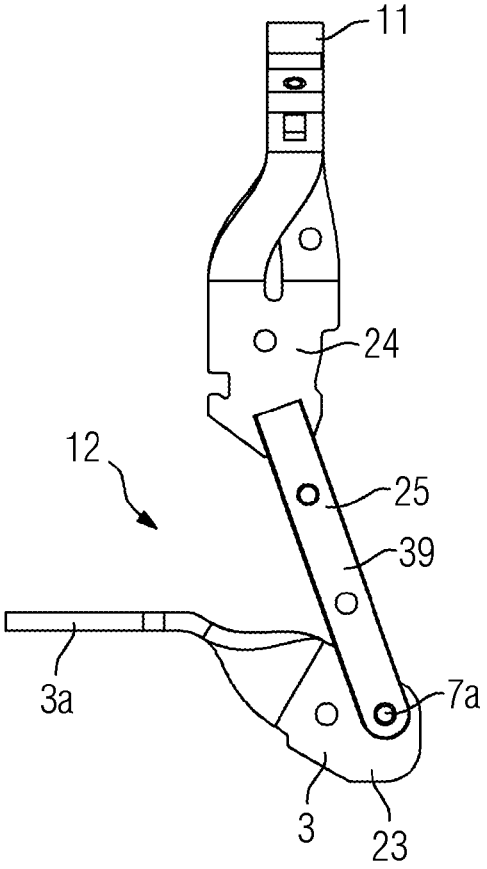
FIG. 7 shows the closed switching contact as shown in FIG. 4 with a double contact element.

FIGS. 7 and 8 show the closed switching contact 12 shown in FIG. 1 with the connection elements 3, 5 and a further contact element 39, which is arranged parallel to the contact element 7, has a flat side 40 and a contact area 41 and moves in synchronism with the movable contact element 7. A contact area 42 formed on the connection element 5 is opposite the contact area 41, the contact area 42 being a subarea of the flat side 24. The flat sides 25, 40 of the two identical moveable contact elements 7, 39 are spaced apart from one another corresponding to the thickness D of the connection elements 3, 5 and are opposite one another and facing one another, wherein they form a slot which receives the plate-shaped connection element 5 during closing of the switching contact 12 in a form-fitting manner with contact areas 27, 28 and 41, 42 sliding against one another (not yet introduced). The flat sides 23, 24, 40 of the connection elements 3, 5 and of the contact element 39 also lie in a common plane F, which runs parallel to the common plane E with the spacing of the thickness D. A central plane M lying centrally between the planes E and F forms, in this embodiment with two contact elements 7, 39, the plane of symmetry of the switching contact 12.

In principle, the common plane E of the left-hand switching contact 12 and the common plane E of the right-hand switching contact 13 do not necessarily need to lie in a common plane. The common plane E of the left-hand switching contact 12 and the common plane E of the right-hand switching contact 13 can differ in terms of their position, for example be shifted parallel to one another. Advantageously, the common plane E of the left-hand switching contact 12 and the common plane E of the right-hand switching contact 13 lie in a common plane E. The same applies here in this exemplary embodiment as for the planes M and F.

As can be seen, the following reference symbols of the left-hand switching contact 12 and of the right-hand switching contact 13 correspond to one another: the connection elements 3, 4, 5, 6 (including connection lugs 3*a*, 4*a*), the contact elements 7, 8, the spindles 17, 18, 19, 20, the flat sides 25, 26, the screws 29, 30, 31, 32, the supporting areas 33, 34, 33*a*, 34*a*, the supporting elements 35, 36, 35*a*, 36*a* and the bearing projection 37, 38, 37*a*, 38*a*.

The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A switch, comprising:

connection elements connectable via a switching contact, the switching contact including a stationary and a movable flat contact area, the movable contact area being formed on a movable contact element movable, over a course of closing, from an open position into a closed position, the stationary and movable flat contact areas each facing one another and being oriented parallel to one another, intersecting one another increasingly over the course of the closing process when viewed transversely with respect to the contact areas, and bearing against one another in the closed position, the connection elements and the movable contact element each including a planar flat side and all of the flat sides lying in a common plane, the connection elements being arranged on one side of the common plane and the movable contact element being arranged on the other side, a subarea of the flat side of one of the connection elements forming the stationary contact area and a subarea of the flat side of the other of the connection elements forming a planar bearing area, and the movable contact element with its flat side bearing movably against the planar bearing area.

2. The switch of claim 1, wherein supporting elements are arranged on a side of the movable contact element, the supporting elements including supporting areas which bear against the flat sides of the connection elements.

3. The switch of claim 2, wherein the movable contact element is formed from a flat body, the movable contact area being arranged on one end of the movable contact element and the bearing area bearing against another end of the movable contact element.

4. The switch of claim 2, wherein the movable contact element is in the form of a pivoting lever and is mounted pivotably.

5. The switch claim 2, wherein the switch includes a housing shell and the supporting elements are integrally formed internally on the housing wall and the connection elements and the movable contact element are arranged in the housing shell.

6. The switch of claim 2, wherein the two connection elements are plate-shaped and have the same thickness.

7. The switch of claim 2, wherein the two connection elements have flat sides which are remote from one another on both sides and which run parallel to one another, wherein a further movable contact element with a flat side is opposite the movable contact element, wherein the two movable contact elements pivot in synchronism and the flat sides of the two movable contact elements face one another and are spaced apart from one another corresponding to the thickness of the connection elements so that they form a slot, which receives the connection element when the switching contact closes, and wherein the movable contact areas of the two contact elements make contact on both sides with stationary contact areas of the connection element.

8. The switch of claim 7, wherein the two flat sides of the two movable contact elements each lie in a common plane with corresponding flat sides of the two connection elements, and wherein the two common planes are spaced apart from one another corresponding to the thickness of the connection elements.

9. The switch of claim 2, wherein the two connection elements are each formed integrally from a flat material with the corresponding thickness by bending.

10. The switch of claim 1, wherein the movable contact element is formed from a flat body, the movable contact area being arranged on one end of the movable contact element and the bearing area bearing against another end of the movable contact element.

11. The switch of claim 1, wherein the movable contact element is in the form of a pivoting lever and is mounted pivotably.

12. The switch claim 1, wherein the switch includes a housing shell and the supporting elements are integrally formed internally on the housing wall and the connection elements and the movable contact element are arranged in the housing shell.

13. The switch of claim 1, wherein the two connection elements are plate-shaped and have the same thickness.

14. The switch of claim 1, wherein the two connection elements have flat sides which are remote from one another on both sides and which run parallel to one another, wherein a further movable contact element with a flat side is opposite the movable contact element, wherein the two movable contact elements pivot in synchronism and the flat sides of the two movable contact elements face one another and are spaced apart from one another corresponding to the thickness of the connection elements so that they form a slot, which receives the connection element when the switching contact closes, and wherein the movable contact areas of the two contact elements make contact on both sides with stationary contact areas of the connection element.

15. The switch of claim 14, wherein the two flat sides of the two movable contact elements each lie in a common plane with corresponding flat sides of the two connection elements, and wherein the two common planes are spaced apart from one another corresponding to the thickness of the connection elements.

16. The switch of claim 1, wherein the two connection elements are each formed integrally from a flat material with the corresponding thickness by bending.

17. The switch of claim 1, wherein the switch is a load interrupter switch.

* * * * *